United States Patent [19]

Held

[11] Patent Number: 4,723,484

[45] Date of Patent: Feb. 9, 1988

[54] METHOD AND APPARATUS FOR CONTINUOUS HOT PRESSING OF MATERIAL WEBS WITH SEAL PROTECTION MEANS

[76] Inventor: Kurt Held, Alte Strasse 1, D-7218 Trossingen 2, Fed. Rep. of Germany

[21] Appl. No.: 912,587

[22] Filed: Sep. 26, 1986

[30] Foreign Application Priority Data

Sep. 27, 1985 [DE] Fed. Rep. of Germany ..... 3534478

[51] Int. Cl.[4] ..... B30B 5/06

[52] U.S. Cl. ..... 100/38; 100/93 P; 100/154; 156/583.4; 156/583.5

[58] Field of Search ..... 100/38, 93 P, 154; 156/583.4, 583.5

[56] References Cited

U.S. PATENT DOCUMENTS

| | | | |
|---|---|---|---|
| 2,364,597 | 12/1944 | Atwood | 156/583.4 |
| 3,185,073 | 5/1965 | Hartesveldt et al. | 100/93 P |
| 3,386,503 | 6/1968 | Corning et al. | 156/583.4 X |
| 4,193,342 | 3/1980 | Held | 100/154 |
| 4,485,733 | 12/1984 | Held | 156/583.5 X |
| 4,494,648 | 1/1985 | Held | 156/583.5 X |
| 4,541,889 | 9/1985 | Held | 100/154 X |

FOREIGN PATENT DOCUMENTS

| | | | |
|---|---|---|---|
| 2248810 | 4/1974 | Fed. Rep. of Germany | 100/93 P |
| 2722197 | 10/1978 | Fed. Rep. of Germany . | |
| 3325578 | 1/1985 | Fed. Rep. of Germany . | |
| 3416985 | 11/1985 | Fed. Rep. of Germany . | |

*Primary Examiner*—Wm. Carter Reynolds

*Attorney, Agent, or Firm*—Toren, McGeady & Associates

[57] ABSTRACT

In a double-band press for the continuous pressing of material webs which require hardening temperatures which are too high to be withstood by the seals of pressure chambers in the double-band press, a pressure plate of the double-band press is divided into an edge area and an inner area, with the edge area having a temperature which is capable of being withstood by the seal material, while the inner area is heated to an increased temperature suitable for processing the material webs. During operation of the apparatus, heat is conducted from the inner area to a portion of the press belt lying against it. The pressure plate is formed with a rectangular recess in which is arranged a pressure plate insert forming the inner area. The pressure plate insert is heated and includes thermal conducting elements which are in contact with the pressure plate insert with one surface and which, with another surface, contacts the press belt in sliding engagement.

18 Claims, 7 Drawing Figures

METHOD AND APPARATUS FOR CONTINUOUS HOT PRESSING OF MATERIAL WEBS WITH SEAL PROTECTION MEANS

The present invention is generally directed to a method and apparatus for continuous hot pressing of material webs and more particularly to an arrangement enabling protection of heat sensitive seals.

In the continuous hot pressing of material webs, double-band presses are used which exert a uniform surface pressure on the material to be pressed, while the material is simultaneously and continuously conveyed through the double-band press. Such material webs can consist, for example, of a plurality of layers of paper webs, glass fiber woven fabrics or fiber-bonding agent mixtures, etc. which are layered one above the other, i.e., in a laminated or sandwiched structure, and which are impregnated with duroplastic resins. As a rule, these workpieces or material webs require the application of a determined temperature during pressing, and, thus, it is necessary to heat the press belts of the double-band press to this temperature.

However, in known methods and devices of this type, the temperatures to which the press belts of the double-band press can be heated are limited by heat resistance or thermal stability of materials which form sealing devices for the pressure chambers in which the surface pressure is hydraulically exerted upon the press belts. For use as sealing materials, only a few elastomers are known which withstand a maximum temperature of 250° C. However, it is often necessary to press material webs which contain resins whose pressing temperature is perceptibly higher, amounting to 380° C. or more.

In order to press material webs at such increased temperatures, a method is known from German patent application No. P 34 16 985 in which the press belts are intensively heated on the outside prior to a reaction zone of the assembly. The outer sides of the press belts which contact the material to be pressed in the reaction zone have the necessary increased temperature, while there is a temperature drop between the outer and the inner sides of the press belt so that the sliding surface seals of the pressure chambers contacting the insides of the press belts are not heated beyond the permissible magnitude.

It is a disadvantage in this method that, particularly with very high temperatures on the outer side of the press belt, there is a large temperature drop between the inner side and the outer side of the press belt which, in turn, results in high heat flow that is only slightly limited because of the favorable metallic thermal conductivity of the press belt material. By means of this, the temperatures on the outer side and on the inner side of the press belt match each other within a short time so that the sliding surface seals contacting the inner sides of the press belt are again exposed to impermissibly high temperatures and are therefore destroyed after a brief operational period. This high heat flow occurs in a completely unrestricted manner, particularly when the belt arrangement involves a single press belt rather than a multilayer belt bundle.

The solution provided in the aforementioned German patent application does not recognize that increased temperatures are unavoidable on the inner side if the outer side of the press belt has an increased temperature. Such high temperatures are actually harmless on the inner side of the press belt apart from the seal area.

SUMMARY OF THE INVENTION

Accordingly, the present invention is directed toward a double-band press which, when heating the press belts to the increased temperature required by the material to be pressed in the reaction zone, limits the temperature in the seal area to the temperature which can be withstood by the material of the seals since the increased temperature of the belts is higher than the maximum temperature compatible with the seal material. The seal arrangement in the double-band press is then safely protected from destruction. This method can be used in a particularly effective manner in double-band presses which are equipped with single-layer press belts.

In accordance with the present invention, material webs are continuously pressed at increased temperature in a reaction zone between two continuous, heated belts of a double-band press, wherein surface pressure is applied to the inner side of the press belts by means of a pressure chamber filled with a pressure fluid. The pressure chambers are defined above and below by the press belt surface and between each press belt and pressure plate. A seal arrangement is provided at the sides of the pressure chambers in sliding contact with the press belts. The temperature required by the material web workpiece is greater than the temperature which can be withstood by the materials of the seal arrangement. Accordingly, the pressure plates are divided into two areas which are separate from one another, namely an inner area and an edge area, with the edge area entirely enclosing the inner area and containing the seal arrangement. The edge area is kept at a temperature which is, at most, equal to the maximum temperature which can be supported by the material of the seal arrangement and the inner area is heated to a temperature which is at least equal to the temperature required by said material web workpiece. Heat is transferred from the inner area to the portion of the press belt contacting the inner area in the reaction zone by means of thermal conduction.

In the apparatus of the present invention, the pressure plates on which the edge area is formed comprises a rectangular recess which lies entirely within the pressure plate. A pressure plate insert which forms the inner area is arranged in this recess with the insert being separated from the pressure plate by means of a gap. A heat source is installed in the pressure plate insert for heating it and thermal conducting elements are arranged between the pressure plate insert and that portion of the press belt which contacts the inner area. Thermal conducting elements contact the pressure plate insert with one surface and they contact the press belt so as to effect a sliding engagement with another surface.

The advantages achieved with the present invention consist, in particular, in that an overheating of the seal arrangement is safely avoided in a double-band press workpiece according to the indicated method and equipped with the aforementioned device, so that the seals are also effectively protected against destruction during continuous operation. It is, accordingly, also possible to press material webs which require an increased temperature. Accordingly, planar workpiece materials which were previously producible, only discontinuously or not at all, may be continuously manufactured.

The various features of novelty which characterize the invention are pointed out with particularity in the claims annexed to and forming a part of this disclosure.

For a better understanding of the invention, its operating advantages and specific objectives attained by its use, reference should be had to the drawings and descriptive matter in which there is illustrated and described a preferred embodiment of the invention.

DETAILED DESCRIPTION OF THE PREFERRED EMBODIMENT

Figure 1:
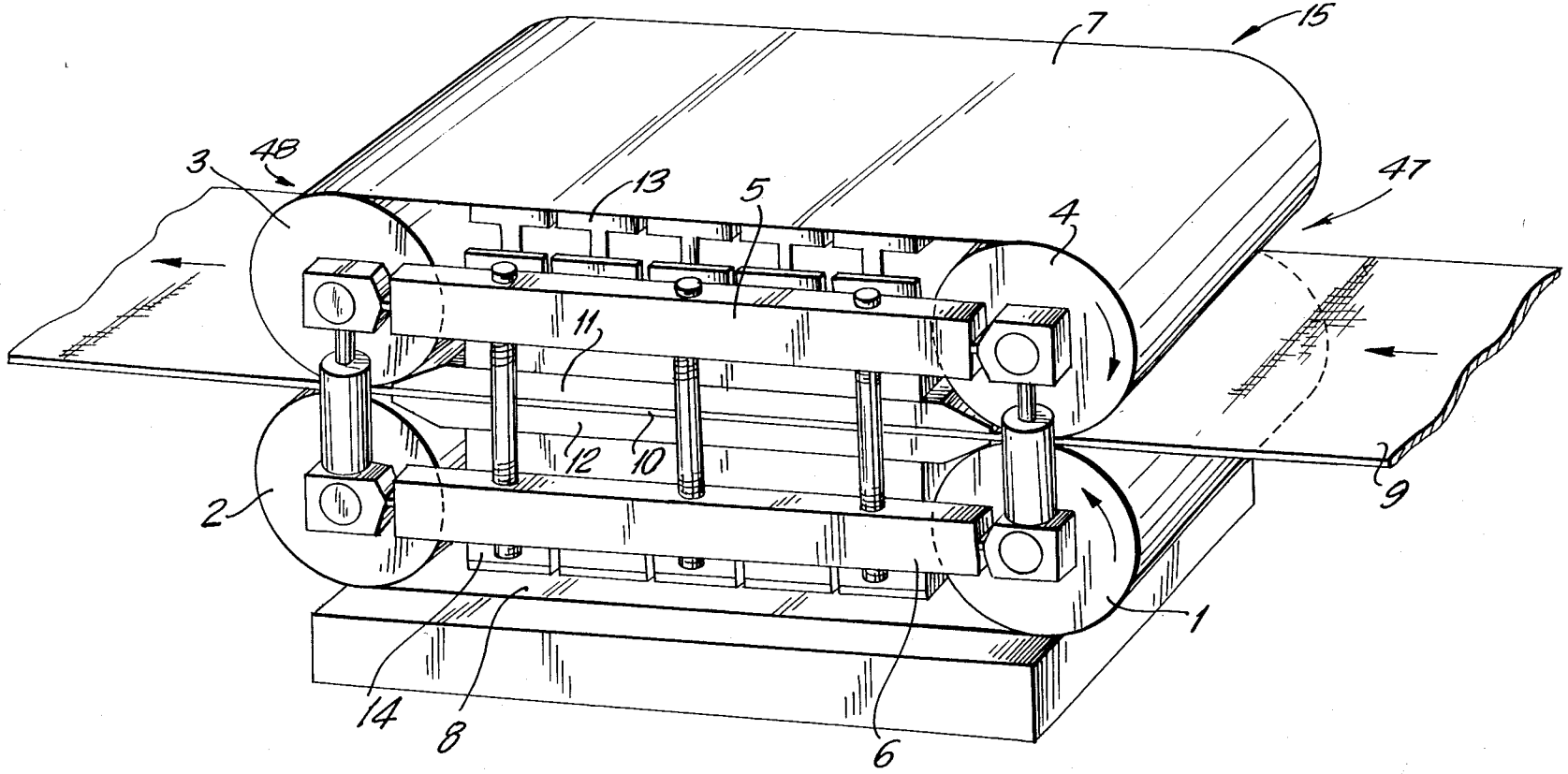
FIG. 1 is a schematic drawing in perspective of the double-band press shown from a side view.

Referring now to the drawings and more particularly to FIG. 1, there is shown a continuously operating double-band press 15 which comprises four deflecting rollers 1, 2, 3, 4 which are rotatably supported in bearing bridges 5, 6. A press belt 7, 8 is guided around each two deflecting rollers which, in each instance, rotate in the direction of the arrows shown in the deflecting rollers 1 and 4. The press belts 7, 8 which normally consist of a high tensile steel are tensioned with known means, for example, hydraulic cylinders fastened in the bearing bridges 5, 6. Defined between the lower portion of the upper press belt 7 located between the rollers and the upper portion of the lower press belt 8 located between the rollers is a reaction zone 10 in which a material web workpiece 9 advancing from right to left in the drawing is pressed under surface pressure and thermal action. The material web workpiece 9 consists of woven fabrics, layered materials or laminates, fiber-bonding agent mixtures and the like which are impregnated with synthetic resin. Such a material web workpiece 9 can be composed, for example, of individual glass fiber woven fabric webs which are layered one upon the other and are impregnated with a polyimide resin.

The surface pressure exerted on the material web workpiece 9 in the reaction zone 10 is applied hydraulically on the inside of the press belt portion 7, 8 located between the rollers via pressure plates 11, 12 and is transmitted from here to the material web workpiece 9. The reaction forces exerted by the material to be pressed are transmitted via pressure plates 11, 12 to the press frame 13, 14 which is indicated only in a schematic manner. The bearing bridges 5, 6 are likewise fastened at the press frame 13, 14.

In order to generate the surface pressure acting on the material web workpiece 9, a fluid pressure medium which can be put under pressure is brought into the space between a pressure plate 11, 12 and the inside of a respective press belt portion 7, 8 located between the rollers. This space constitutes a pressure chamber 16 and is defined at the sides by a self-contained seal arrangement 17 seen in FIG. 2. A synthetic oil is preferably used as the pressure medium. However, a gas, for example, compressed air, can be used just as well.

Figure 2:
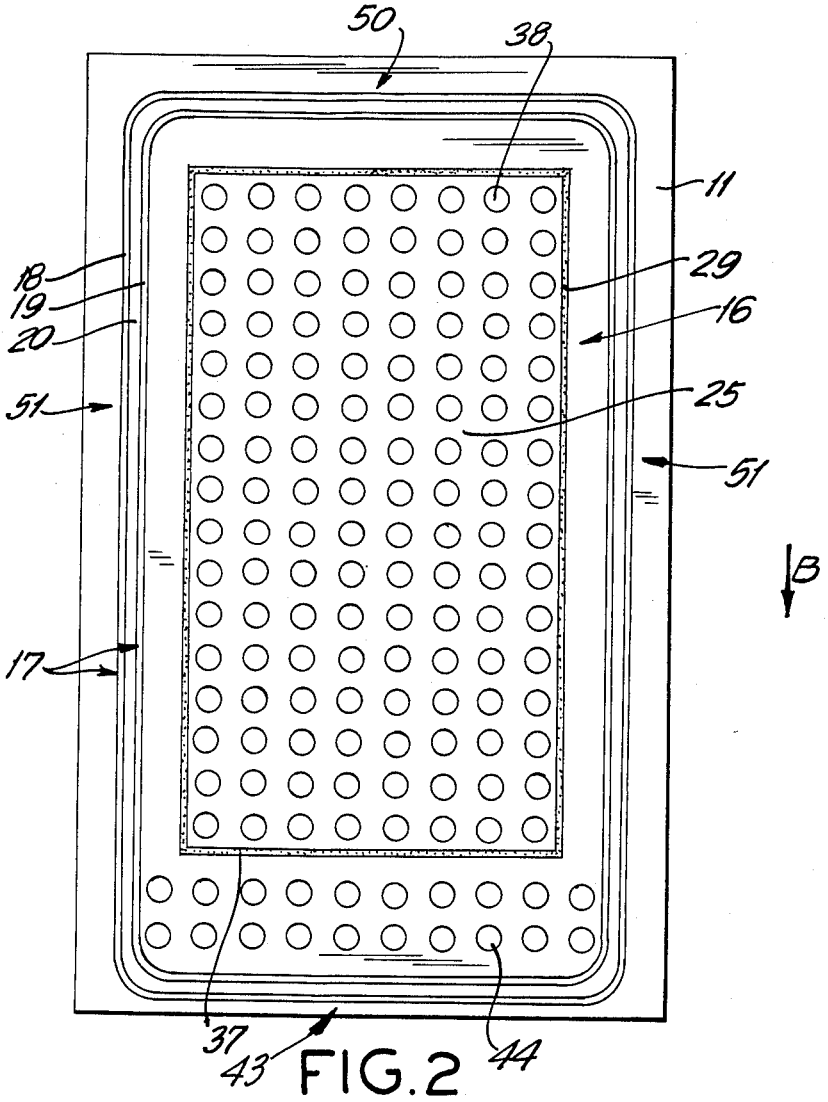
FIG. 2 is a top view of the pressure plate as seen from the rear of the press belt.
Figure 3:
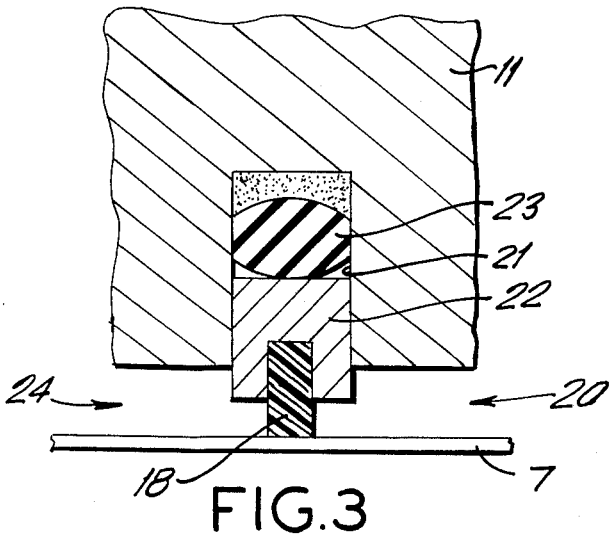
FIG. 3 is a section through a sliding surface seal.

The pressure chamber 16 is shown in top view in FIG. 2 as seen from the pressure side of the press belt. The pressure plate 11 consists of a steel plate and has a rectangular shape. The seal arrangement 17 is located in an edge area of the pressure plate 11 and consists of two self-contained sliding surface seals 18 or 19 which lie adjacent each other and are separated by means of an intermediate space 20. These sliding surface seals 18, 19 are arranged in grooves 21 which are located in the pressure plate 11 and, as shown in FIG. 3, the sliding surface seal 18 contacts the press belt 7 which moves under the sliding surface seal 18 with a slight abrading or grinding action. With its side remote from the press belt, the sliding surface seal 18 is securely inserted in a U-shaped holding strip 22 which lies against the walls of the groove 21 with a slight play. On the U-shaped holding strip 21, a groove seal 23 of elastic or resilient material which is constructed as an O-ring lies on the side remote from the press belt 7. A pressure means acts on this groove seal 23 proceeding from the groove base of the groove 21, so that the holding strip 22 and, along with it, the sliding surface seal 18 is pressed against the press belt 7 and the pressure chamber 16 is accordingly sealed against the atmosphere side 24. Holders for the U-shaped holding strip 22 in the pressure plate 11 are known in the prior art, for example, from German Patent DE-PS No. 27 22 197, thus further description thereof is not necessary for a full understanding of the invention. Additionally, as can be seen from FIG. 7, leakage of the pressure means from the pressure chamber 16 collects in the intermediate space 20 between the two sliding surface seals 18 and 19 and can be suctioned off from there via boreholes 45 and a collecting line 46.

Figure 4:
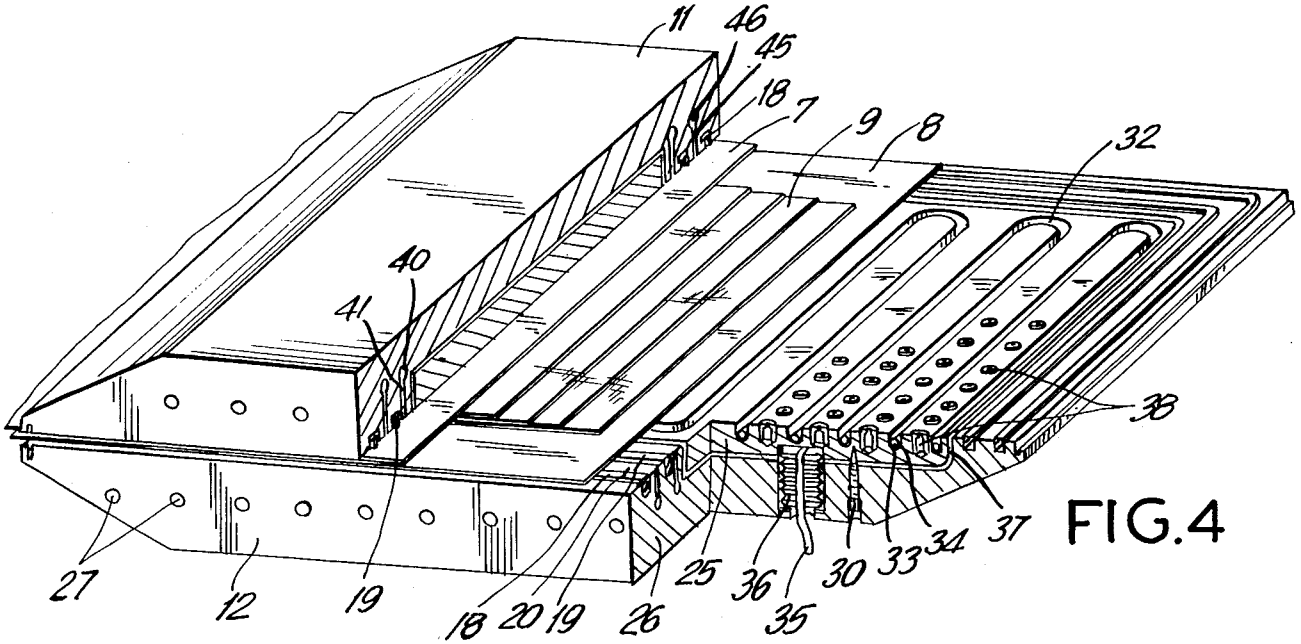
FIG. 4 shows the pressure plates, in perspective, partially in section.

The sliding surface seal 18, 19 consists of a plastic material, preferably an elastomer. Such workpiece materials, however, can only withstand maximum temperatures up to 250° C. in long-term operation and this temperature is hereinafter designated T1. However, many material web workpieces 9 require substantially higher temperatures T2 for hardening or curing during pressing. For example, for layered materials consisting of glass fiber woven fabrics, which are impregnated with a polyimide resin, temperatures of up to 380° C. are required. Also, in order to use the double-band press for such cases, the pressure plate is divided into an edge area and a separate inner area in the method according to the invention. As seen in FIG. 4, this inner area is formed by a pressure plate insert 25 which lies within the pressure chamber 16 and within the edge area of the rest of the pressure plate 11, 12. The pressure plate insert 25 is heated to a temperature T3 which is increased relative to the pressure plate 11, 12 and which is at least as great as temperature T2, but preferably greater than the latter. The pressure plate 11, 12 is held at a temperature which is, at most, as great as T1.

Figure 7:
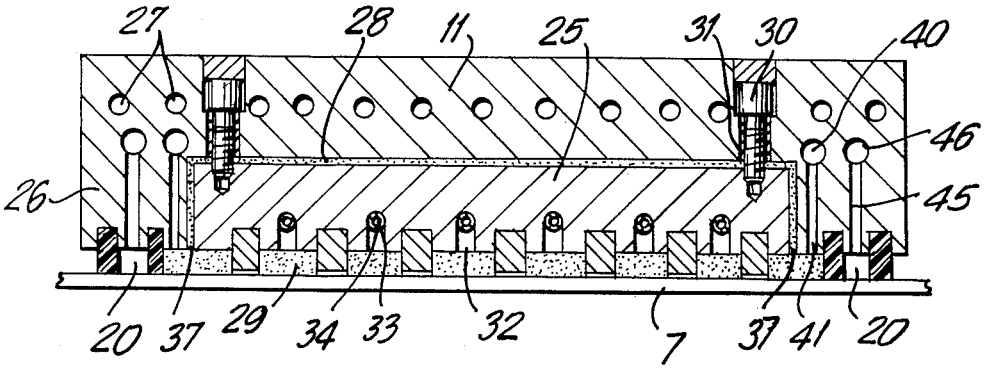
FIG. 7 shows a pressure plate in longitudinal section.

The pressure plate insert 25 is shown in FIGS. 4 and 7. The pressure plate 11, 12 comprises a trough-shaped, rectangular recess 28 which is enclosed by a raised edge 26 in which the seal arrangement 17 is arranged. The pressure plate insert 25 is located in this recess 28 so as to be supported in a floating manner on pressure means 29 so that there is a gap 37 between the pressure plate 11, 12 and the pressure plate insert 25, which gap is filled with the pressure means 29. The pressure plate insert 25 is securely connected with the pressure plate 11, 12 at a few places by connecting means having a small cross section in order to absorb shearing or thrust forces. Such connecting means can be, e.g., screws 30 with sleeves 31. The distance between pressure plate 11, 12 and pressure plate insert 25 can be kept small, for example, approximately 1 mm. However, if necessary, because of the thermal insulation, it can also be selected to be greater.

At its surface facing the press belt, the pressure plate insert 25 comprises grooves 32 which are arranged in a serpentine manner to extend transversely across its width, with a heating coil 33 which is likewise serpentine being inserted in the grooves 32. The heating coil 33 is covered or lined by a copper tube 34 which is fastened to the walls of the groove 32 with a favorable thermal conductivity. The heating coil 33 is provided with electrical energy via feed lines 35. These feed lines 35 are guided from the outside through a bellows or sealing boot 36 which connects the pressure plate 11, 12 with the pressure plate insert 25 at place so as to be sealed against the pressure means 29 in the gap 37. By means of the heating coil 33, the pressure plate insert 25 which consists of metal is heated to a temperature T3 which is preferably greater than the temperature T2 required for hardening of the material web workpiece 9. If desired, heating of the pressure plate insert 25 can also be effected by means of heated thermal oil which circulates through boreholes 52 arranged in the pressure plate insert 25 via feed and let-off lines which are guided in the bellows 36. (See FIG. 5.)

The pressure plate 11, 12 itself is heated to a temperature T1 which is, at most, equal to the maximum continuous temperature which can be supported by the material of the sliding surface seal 18, 19, but is preferably at a perceptibly lower temperature. In addition, thermal oil flows through boreholes 27 which are arranged in the pressure plate 11, 12. By means of this, the raised edges 26 of the pressure plate 11, 12 will also be at temperature T1 and the sliding surface seals arranged in these raised edges 26 are maintained at this temperature T1.

If necessary, the pressure plate 11, 12 can also be cooled by a cooling liquid with a suitably selected temperature which flows through the boreholes 27. Hardly any heat flows from the pressure plate insert 25 to the pressure plate 11, 12 since the pressure plate 11, 12 and the pressure plate insert 25 are separated by the gap 37 which is filled by the fluid. Since insert 25 is at the increased temperature T3, this avoids damage to the material of the sliding surface seal 18, 19. The fluid pressure means 29 has very poor heat conductivity, as known, and, in practice, is a thermal insulator. Accordingly, heat flow can only occur in the pressure plate 11, 12 at those places where the pressure plate 11, 12 and the pressure plate insert 25 are connected with one another by means of the bellows, screws 30 and the like. However, this heat flow is very slight since only a few such connecting points are provided and these have a small cross section. If necessary, this minimal, flowing heat quantity can be removed by means of cooling the pressure plate 11, 12, thereby ensuring that the temperature T1 at the seal arrangement in the raised edges 26 of the pressure plate 11, 12 is not exceeded.

Figure 6:
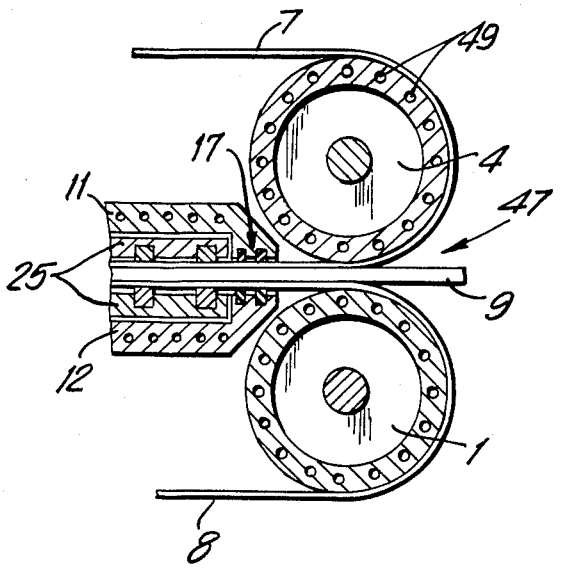
FIG. 6 shows the inlet zone of a double-band press with the deflecting rollers on the inlet side in section.

As shown in FIG. 6 which is a section taken through an inlet zone 47 in the double-band press 1, the deflecting rollers 1 and 4 at the inlet side are provided with boreholes 49 which extend in the vicinity of the outer surface area of the deflecting rollers 1, 4. Circulating through the boreholes 49 is heated thermal oil which heats the outer surface area of the deflecting rollers and, in so doing, simultaneously heats by means of thermal conductivity that part of the press belts 7, 8 which contacts the deflecting rollers 1, 4 during the forward running of the press belts 7, 8. The heating of the press belts 7, 8 is controlled in such a way that when leaving the deflecting rollers 1, 4, they are, at most, at temperature T1 which is harmless for the material workpieces of the sliding surface seal 18, 19. After leaving the deflecting rollers 1, 4, the press belts 7, 8 run further in the direction of the reaction zone 10 and, in so doing, pass the front axial portion 50 of the sliding surface seal arrangement 17 in the pressure plate 11, 12. This refers to that portion of the sliding surface seals 18, 19 which extends perpendicularly relative to the advancing direction of the press belt over the width of the pressure plate 11, 12 and faces the inlet zone 47. Since, during the passage of the front axial portion 50, the press belts 7, 8 have a maximum temperature T1, the sliding surface seals 17, 18 of the front axial portion 50 are protected from excessive thermal influence. If heating of the press belts 7, 8 by the deflecting rollers 1, 4 at the inlet side is not desired, this can also be dispensed with so that the press belts 1, 4 pass the front axial portion at room temperature. However, since the temperature T1 is not yet sufficient for pressing the material web workpiece 9, an additional heating of the press belts 7, 8 is effected after passage of the front axial portion 50 by the press belts 7, 8.

For this heating of the press belts 7, 8 to the temperature T2 required for pressing of the material web workpiece 9, thermal conducting elements 38 are arranged in the pressure plate insert 25. As can be seen in FIG. 4, these thermal conducting elements 38 comprise a circular cross section and are inserted in boreholes in the pressure plate insert 25 in such a way that they effect favorable thermal contact with the pressure plate insert 25. The thermal conducting elements 38 contact the press belt 7, 8 with the surface remote from the pressure plate insert 25 so as to slide. At the entrance into the reaction zone 10, the press belts 7, 8 are, at most, at temperature T1 so that a temperature drop prevails between the pressure plate insert 25 at temperature T3 and the press belts 7, 8. Therefore, heat flows from the pressure plate insert 25 to the press belt 7, 8 via the thermal conducting elements 38 which consist of a thermal conducting material such as copper, while the press belt is moved through the reaction zone 10 and heats the latter. The quantity of thermal conducting elements 38 as well as the temperature T3 of the pressure plate insert 25 is selected in such a way that the press belt is heated to the increased temperature T2 required by the material web workpiece 9. The arrangement of the thermal conducting elements 38, as seen from FIG. 2, is such that only the portion of the press belt 7, 8 assigned to the pressure plate insert 25 and located between the two lateral portions 51 of the inner sliding surface seal 19 is heated to the increased temperature T2, not the lateral edge area of the press belt contacting the sliding surface seals 18, 19. As can be seen from FIG. 4, in addition, the material web workpiece 9, which consists in this embodiment of a plurality of layers of a glass fiber woven fabric impregnated with polyimide resin, has a width which is, at most, equal to the width of the pressure plate insert 25 so that the material web workpiece lies precisely on the portion of the press belt 7, 8 in the reaction zone which is at the increased temperature T2. The construction of the thermal conducting elements 30 is known, per se, in the prior art from German Offenlegungsschrift DE-OS No. 33 25 578 so that they need not be described in more detail.

Since there is a temperature drop on the press belt 7, 8 in the axial direction (that is, the direction perpendicular to the advancing direction of the press belt) between the inner area (which is acted upon by the pressure plate insert with heat and is at temperature T2) and the edge area along the latter portion 51 of the sliding surface seal (which is at temperature T1), heat flow can occur which heats the sliding surface seals 18, 19 to an impermissible extent. The lateral portion 51 refers to that portion of the seal arrangement 17 which extends in the advancing direction of the press belts 7, 8. In order not to allow the heat to act upon the sliding surface seal 18, 19, an additional cooling of this edge area of the press belt can be provided.

Such apparatus for cooling the edge area of the press belt 7, 8 is seen in FIG. 4. Arranged in the raised edge 26 of the pressure plate 11, 12 is a collecting line 40 for the working substance or pressure fluid extending in the advancing direction of the press belt. Extending from the surface of the raised edge 26 facing the press belt are boreholes 41 for the collecting line 40, which boreholes 41 are arranged at certain distances from one another. These boreholes are arranged in the vicinity of the inner sliding surface seal 19 on the side facing the pressure plate insert 25. A portion of the pressure means 29 flows into the collecting line 40 via these boreholes 41 and is guided from there into the supply vessel or reservoir for the pressure means from where it is fed anew to the pressure chamber 16. By means of this circulation, the pressure means absorbs heat from the edge area of the press belt 7, 8 by convection, and, thus, prevents heating of the edge area above the magnitude allowable for the sliding surface seal.

Figure 5:
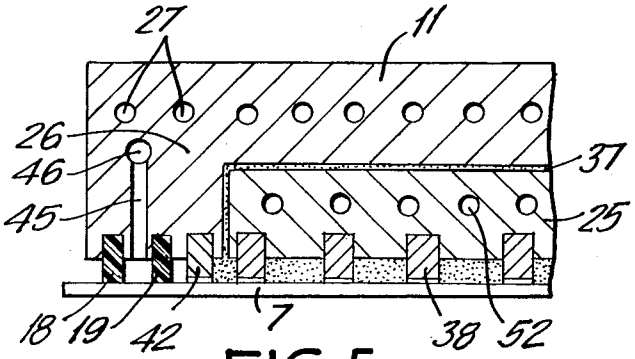
FIG. 5 shows the edge area of the pressure plate and of the press belt in section in a modified embodiment.

If such cooling of the edge area of the press belt is not sufficient, then thermal conducting elements can also be provided in this edge area. As can be seen in FIG. 5, thermal conducting elements 42 which are constructed according to those in the pressure plate insert 25 are arranged in the raised edge 26 of the pressure plate 11, 12 in the vicinity of the sliding surface seal 19 on the side facing the gap 37. These thermal conducting elements 42 contact the press belts 7, 8 in the edge area so as to slide on the one hand and, on the other hand, have contact with the raised edge 26. Since the pressure plate is, at most, at temperature T1, but preferably at a lower temperature because of cooling, the heat coming from the inner area of the press belt then flows over the thermal conducting elements 42 into the raised edge area 26 and is guided away from there with the cooling fluid for the pressure plate 11, 12. It is accordingly safely ensured that the temperature of the press belt in the edge area does not increase above temperature T1 to be withstood by the sliding surface seals 18, 19.

The rear axial portion 43 of the seal arrangement 17, i.e., the portion of the seal arrangement 17 extending across the press belt perpendicular to direction B, comes into contact during the advance of the press belt 7, 8, with the area of the press belt 7, 8 at an increased temperature so that overheating of the sliding surface seals 18, 19 must likewise be prevented there. In addition, as shown in FIG. 2, thermal conducting elements 44 are arranged in the area between the gap 37 and the rear axial portion 43 so as to contact the pressure plates 11, 12. These thermal conducting elements 44 again contact the press belt so as to slide and guide the heat away from the press belt into the pressure plate 11, 12 since a temperature drop prevails in this area between the press belt which is heated to temperature T2 and the pressure plate, whose temperature is at most T1, but preferably lower. The quantity of thermal conducting elements 44 is selected so that the press belt again reaches temperature T1 which is harmless for the material of the sliding surface seal as soon as the press belt has arrived at the axial portion 43 of the sliding surface seal. If this cooling distance is not sufficient, each pressure plate 11, 12 can be divided into two portions, wherein that portion of the pressure plate which has the thermal conducting elements 44 is intensively cooled independently of the other portion of the pressure plate in which the pressure plate insert 25 is located.

Accordingly, it is also ensured that the rear axial portion 43 of the seal arrangement 17 is not overloaded by excessive temperature.

In order to obtain a final product which satisfies qualitative demands, it must be ensured that, during passage of the material web workpiece 9 through the double-band press, the length of the pressure plate insert 25 in the advancing direction of the press belt and the speed of the press belts 7, 8 are selected in such a way that the material web workpiece is completely hardened or cured within the time in which it is located in the area of the reaction zone 10, whose dimensioning is determined by the pressure plate insert 25. In the event that the width of the material web workpiece 9 is selected so as to be greater than the width of the pressure plate insert 25, the edge of the material web workpiece 9 which is pressed in the area contacting the raised edge 26 is cut off after the workpiece 9 has left the double-band press 15 at the outlet zone 48 since this is not completely hardened because of a temperature which is too low.

While a specific embodiment of the invention has been shown and described in detail to illustrate the application of the inventive principles, it will be understood that the invention may be embodied otherwise without departing from such principles.

What is claimed is:

1. In a method for the continuous hot pressing of material workpieces at a processing temperature within a reaction zone defined in a double-band press between two continuous heated press belts wherein surface pressure is applied on an inner side of said press belts through a fluid press medium contained within a pressure chamber defined between each of said press belts and a pressure plate above and below said reaction zone, said pressure chambers being laterally enclosed by sealing means in sliding engagement with said press belts, said sealing means being formed of a material which is incapable of withstanding said processing temperatures required for the processing said workpieces, the improvement comprising the steps of: dividing said pressure plate into an inner area and an edge area which are separate from each other, with said edge area surrounding said inner area and having said sealing means located therein; maintaining said inner area thermally insulated from said edge area by a fluid medium; maintaining said edge area at a first temperature not greater than a safe temperature which can be withstood by said material of said sealing means; heating said inner area to a second temperature which is at least equal to said processing temperature required for processing said workpieces and which is higher than said safe temperature; and conducting heat from said inner area to portions of said press belts contacting said inner area in said reaction zone.

2. A method according to claim 1, wherein said edge area is heated to a temperature which is at most equal to the maximum temperature which can be withstood by the material of said sealing means.

3. A method according to claim 1, wherein said edge area is cooled to a temperature which is lower than the maximum temperature which can be withstood by the material of said sealing means.

4. A method according to claim 1, wherein said press belts enter said reaction zone at a temperature which is not greater than said safe temperature of said sealing means.

5. A method according to claim 1, wherein said fluid medium simultaneously serves as pressure means.

6. A method according to claim 1, wherein said press belt is cooled after leaving said inner area in such a manner that when reaching a portion of said sealing means extending perpendicularly relative to the advancing direction of said press belt and extending behind said inner area, as seen in an advancing direction of said press belt, is at a temperature not greater than the safe temperature of said sealing means.

7. A method according to claim 1, wherein said web material workpieces have a width which is not greater than a width of said inner area.

8. A method according to claim 1, wherein said web material workpieces have a width which is greater than the width of said inner area and not greater than a width of said press belt and wherein said material web workpieces have edges hardened without pressure, said edges being trimmed after pressing of said workpieces in said reaction zone.

9. Apparatus for continuously hot pressing material web workpieces at a processing temperature comprising:

double-band press means having a pair of continuous heated press belts defining therebetween a reaction zone, wherein surface pressure is applied to said workpieces;

means including a pair of pressure plates defining pressure chambers filled with a fluid pressure medium for applying said surface pressure to said press belts on opposite sides of said reaction zone, said pressure chambers bieng located each between a press belt and a pressure plate;

sealing means in sliding contact with said press belts laterally bounding said pressure chambers, said sealing means being formed of a material capable of being exposed to a safe temperature which is lower than said processing temperature at which said workpieces are processed;

means dividing said pressure plates into an inner area and an edge area surrounding said inner area, said sealing means being located in said edge area;

means maintaining said edge area at a first temperature not greater than said safe temperature of said sealing means;

means for heating said inner area to a temperature at least equal to said processing temperature; and means for conducting heat from said inner area to portions of said press belts contacting said inner area in said reaction zone;

said means dividing said pressure plates comprising a rectangular recess formed entirely within said pressure plates and a pressure plate insert defining said inner area and arranged in said recess, said pressure plate insert being separated from said pressure plates by means of a gap, wherein said means for heating said inner area comprise a heat source installed in said pressure plate insert in order to heat said insert, and wherein said conducting means comprise thermal conducting elements between said pressure plate insert and a portion of said press belts which contact said inner area, said thermal conducting elements having one surface contacting said pressure plate insert and another surface contacting said press belt in sliding engagement.

10. Apparatus according to claim 9, wherein said pressure plate insert is fastened to said pressure plate at only a few places by mechanical fastening means having small cross-sectional areas.

11. Apparatus according to claim 10, wherein said fastening means comprise screws and distance sleeves located in said gap.

12. Apparatus according to claim 9, wherein said heat source is formed by an electrical heating coil.

13. Apparatus according to claim 12, wherein said heating coil is arranged in a serpentine shape in grooves in said pressure plate insert.

14. Apparatus according to claim 9, wherein said heat source comprises boreholes in said pressure plate insert and heat transfer means flowing through said boreholes.

15. Apparatus according to claim 9, further comprising bellows means connecting said pressure plate and said pressure plate insert sealed against said gap, and feed lines for said heat source in said pressure plate insert guided through said pressure plate in said bellows.

16. Apparatus according to claim 9, wherein said sealing means include a pair of sliding surface seals having a lateral portion arranged in the advancing direction of said press belts, said sliding surface seals including an inner sliding surface seal, said pressure plate including a raised edge defining said edge area with said sealing means being located in said raised edge with portions of said press belt which lie in the area of said raised edge along said lateral portion of said sliding surface seals being cooled by means of a flowing pressure medium operating by convection, said pressure medium being suctioned off through boreholes which are located in the vicinity of said inner sliding surface seal along said lateral portions so as to face said pressure chamber and open into a collecting line located in said raised edge and being fed from there to a supply vessel for said pressure medium.

17. Apparatus according to claim 9, wherein said sealing means include an inner sliding surface seal having a lateral portion which is arranged in the advancing direction of said press belt and wherein said pressure plates are formed with a raised edge defining said edge area, said sealing means being located in said raised edge with thermal conducting elements being arranged in said raised edge so as to face said pressure chamber along said lateral portion of said inner sliding surface seal, said thermal conducting elements contacting said raised edge with one surface and contacting said press belts in sliding engagement with another surface at a portion assigned to said lateral portion of said sliding surface seal, with heat being guided from this portion of the press belts into said pressure plates.

18. Apparatus according to claim 9, wherein said pressure plates include raised edges defining said edge area and wherein said sealing means include a rear axial portion which extends perpendicularly relative to the advancing direction of said press belts and is arranged behind said pressure plate insert in the advancing direction of said press belts, said sealing means being located in said raised edges with thermal conducting elements being provided which face said pressure chamber and which are arranged in said raised edge along said rear axial portion of said sealing means, said thermal conducting elements contacting said raised edge with one surface and contacting said press belts in sliding engagement with another surface at a portion located between said rear axial portion of said sealing means and said pressure plate insert so that heat is conducted away from said portion of said press belts into said pressure plates and said press belts when passing said rear axial portion will have a temperature which is not greater than said safe temperature of said sealing means.

* * * * *